US005244255A

United States Patent [19]

Hill

[11] Patent Number: 5,244,255

[45] Date of Patent: Sep. 14, 1993

[54] FOLDING FOOTREST

[76] Inventor: Alma K. Hill, P.O. Box 1026, Port Salerno, Fla. 34992

[21] Appl. No.: 862,375

[22] Filed: Apr. 2, 1992

[51] Int. Cl.[5] ..... A47C 16/02

[52] U.S. Cl. ..... 297/423.41; 248/222.3

[58] Field of Search ..... 297/54, 439; 108/127, 108/132, 43, 49; 248/165, 166, 222.3

[56] References Cited

U.S. PATENT DOCUMENTS

| | | | |
|---|---|---|---|
| 1,386,612 | 8/1921 | Farah | 297/54 |
| 2,133,781 | 10/1938 | Johnson | 248/222.3 X |
| 2,271,250 | 1/1942 | Buchholz | 248/222.3 X |
| 3,065,992 | 11/1962 | Nagel | 297/439 |
| 3,117,816 | 1/1964 | De Sena | 297/439 |
| 3,859,930 | 1/1975 | Sherwin | 297/439 X |
| 4,228,745 | 10/1980 | Gale | 297/439 X |
| 4,437,413 | 3/1984 | O'Brian . | |
| 4,462,636 | 7/1984 | Markson | 297/439 |
| 4,819,568 | 4/1989 | Coffrin | 108/43 |

*Primary Examiner*—Kenneth J. Dorner
*Assistant Examiner*—J. Bonifanti
*Attorney, Agent, or Firm*—Alvin S. Blum

[57] ABSTRACT

A folding footrest has a thin, flat rectangular platform with a foot-supporting upper surface and hinges at two opposed short sides that pivotally connect to a pair of flat legs. The legs support the platform in an elevated position above a surface on which the legs rest. This provides an elevated footrest, especially for the seated short person. The hinges permit the legs to swing the from the vertical operative position in which both legs are parallel to one another and extended downward at right angles to the platform to the folded, transport position lying flat on top of upper surface of the platform. By covering the soiled foot-supporting surface of the platform with the folded legs, a more sanitary folded package is provided for carrying in pocket or purse. The hinge cooperates with the legs and platform to stop the legs from moving toward one another when in the operative position. A removable strut extends between, and engages, both legs in the operative position to prevent the legs from moving away from one another. The strut also serves as a toe hold for moving the footrest about.

8 Claims, 1 Drawing Sheet

FOLDING FOOTREST

FIELD OF THE INVENTION

This invention relates to footrests, and more particularly to footrests that fold into compact form for carrying about in pocket or purse.

BACKGROUND OF THE INVENTION

It is well recognized that physical discomfort in the lower back of a seated person can often be relieved by elevating the feet on a footrest, footstool or ottoman. Furthermore, the serious complications from dependant edema from prolonged sitting may be reduced by elevating the feet on a footrest of some sort. People with short legs are also often in need of a footrest when seated in vehicles and ordinary chairs because their feet may not reach the floor, and excessive forces are consequently put on the thighs.

It is awkward to carry about an ordinary ottoman or footstool.

U.S. Pat. No. 4,462,636 issued Jul. 31, 1984 to Markson teaches a folding footstool including a platform for the feet to rest upon and a pair of vertical legs pivotally attached to opposite ends of the platform that fold up underneath the platform for portability. A pair of pivotally connected diagonal braces hold the legs open in a complex structure that prevents the legs from folding toward one another.

U.S. Pat. No. 4,437,413 issued Mar. 28, 1984 to O'Brian teaches a folding platform in which the legs also fold underneath the platform with a complex Sarrus linkage. In both inventions, the soiled platform surface upon which the feet have rested is exposed on an outer face of the folded package. The complex leg bracing mechanism is expensive and heavy. To be suitable for most applications, the folding footrest should be simple, light, compact and inexpensive.

The prior art designs are much stronger than is needed for merely holding the weight of the feet.

SUMMARY OF THE INVENTION

It is accordingly an object of the invention to provide a folding footrest that is simple to operate, light in weight, compact when folded and inexpensive to manufacture. It is another object of the invention to provide a folding footrest in which the soiled surface of the platform upon which the feet rest is covered by the legs when in the folded condition for more sanitary portability.

The folding footrest of the invention comprises a rectangular horizontal platform having two short sides to each of which a rectangular leg is pivotally connected by a hinge in such a fashion that each leg can pivot from a closed position lying flat on top of the platform to an open vertical position with the hinge arranged to prevent the legs from folding underneath the platform. A single elongate brace removably connects both legs together when they are vertical, the brace preventing the legs from moving away from one another.

These and other objects, features and advantages of the invention will become more apparent when the detailed description is studied in conjunction with the drawings, in which:

DETAILED DESCRIPTION OF PREFERRED EMBODIMENTS

Figure 1:
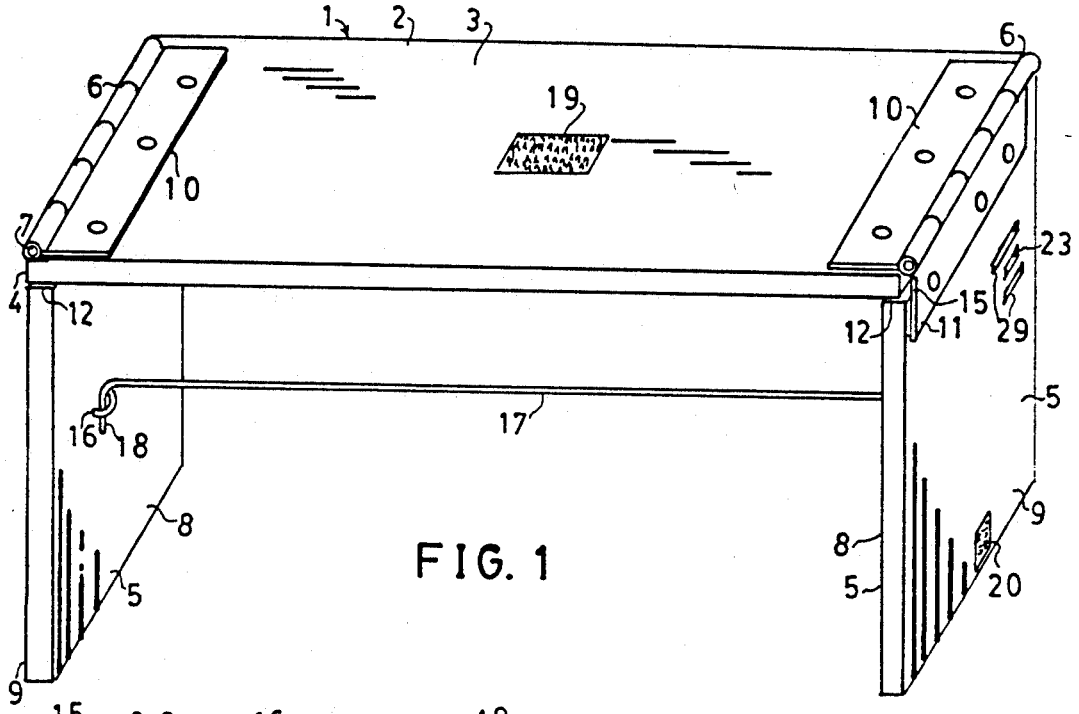
FIG. 1 is a perspective view of a footrest on the invention in open condition.
Figure 2:
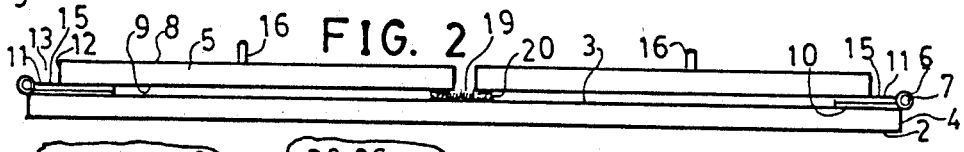
FIG. 2 is a side elevation view of the footrest of FIG. 1 in closed condition.

Referring now first to FIGS. 1 and 2, a footrest 1 of the invention is shown in the operative mode in FIG. 1 and in the folded mode for storage and transport in FIG. 2. The footrest comprises a thin, flat, rectangular platform 2 having a foot supporting upper surface 3. Two flat rectangular legs 5 support the platform in an elevated position above a surface on which the legs rest to provide an elevated foot supporting surface for a seated person. The legs 5 are hingedly joined to the two short sides 4 of the platform by hinges 6, having pivot pins 7, about which the legs 5 are permitted to rotate relative to platform 2 between the flat folded position of FIG. 2, in which the legs cover the soiled foot supporting upper surface of the platform to the operative position orthogonal to the platform and extending downward and parallel to one another as in FIG. 1.

Each hinge 6 is comprised of a pair of rigid leaves 10, 11 pivotally joined by a hinge pin 7 in a manner well known in the art. A leaf 10 of the hinge is fastened to a short side 4 of the platform 2 such that the pin is adjacent the side 4. The other leaf 11 of the hinge is fastened to the upper edge 12 of a leg so as to leave a gap 13 slightly greater than the thickness 14 of the platform between the upper edge 12 of a leg and the hinge pin 7. This causes the overhanging portion 15 of leaf 11 to act as a stop when it impinges on the edge 4 of the platform in the operative mode to prevent the legs from moving toward one another.

Figure 4:
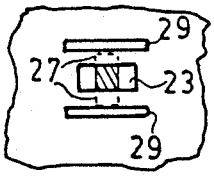
FIG. 4 is a sectional detail view of the strut of FIG. 3 in locked position.
Figure 5:
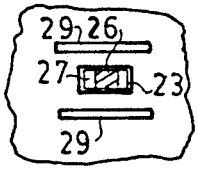
FIG. 5 is a sectional detail view of the strut of FIG. 3 in unlocked position.
Figure 3:
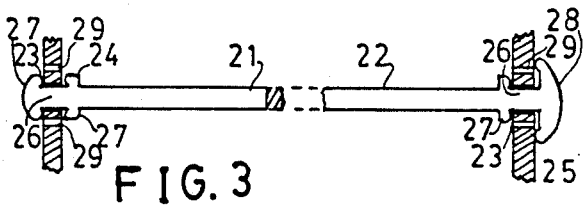
FIG. 3 is a plan view of a strut for the footrest.

To prevent the legs from moving away from one another in the operative mode, the inner face 8 of each leg is provided with an eye, or loop 16. An elongate removable strut 17 of heavy wire with a right angle member 18 at each end engages the loop 16 at each leg. This is simply lifted out of the loops to permit the legs to be folded over the upper surface of the platform to cover the soiled surface for sanitary transport. A piece of hook and loop fastening material 19 on the platform surface 3 engages complementary hook and loop fastening material 20 on the outer faces of the legs to secure the footrest in the folded mode. FIGS. 3, 4, 5 show an alternate form of strut 21, having an elongate central member 22 with a leg-engaging means 24, 25 at each opposed end arranged for cooperating with a rectangular slot 23 in each leg 5. Each leg-engaging means includes a narrow inner portion 26 having a square transverse section joining laterally projecting portions 27 and 28. The laterally projecting portions 27 are dimensioned to fit through rectangular slots 23 when aligned with the slots while portion 28 serves as a stop since it is too wide to fit through the slots 23 and it also serves as a handle for rotating the strut ninety degrees to lock the strut in place with the lateral projections then preventing movement of the legs. The dimensions of the square inner portion 26 of the leg engaging means are for a snug fit in the slot 23, so that the diagonal of the square is greater than the height of the slot. When rotating the strut about its long axis with handle 28, between locked position (FIG. 4) and unlocked position (FIG. 5), the resilient walls of the slot 23 are forced away from one another and resiliently spring back toward one another to provide a springy detent arrangement. Releasing slits 29 provide yielding space for movement of the walls of slots 23.

Figure 6:
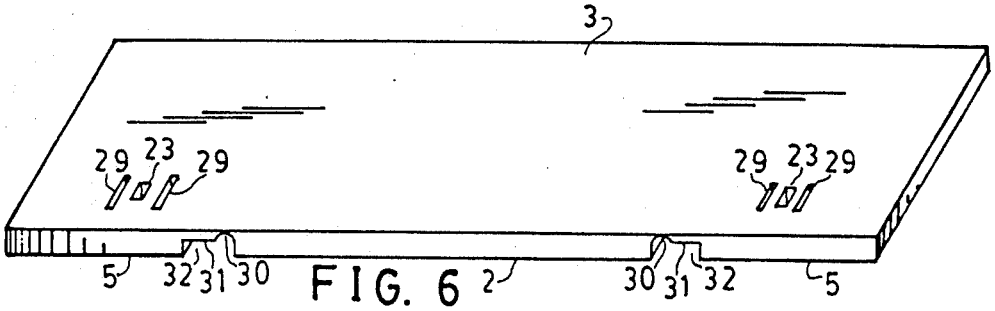
FIG. 6 is a perspective view of another embodiment of the footrest designed for one piece molding.

FIG. 6 shows an alternative embodiment of the footrest that may be molded in one piece of plastic, such as polyolefin with built-in living hinges 30, rigid leaf portions 31, and gaps 32. It is provided with slots 23 and slits 29 for use with the strut 21 of FIGS. 3-5. The strut extending between the legs and beneath the platform serves an additional purpose. It provides a toe hold for moving the platform about without bending over.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A portable folding footrest comprising:

A) a thin, rectangular platform having a foot-supporting upper surface and two long opposed sides and two short opposed sides;

B) a pair of thin, flat leg means for supporting said platform in an elevated position above a surface on which the footrest is disposed, each leg means having opposed first and second support ends;

C) hinge means pivotally connecting each short side of said platform to a first end of a leg means, said hinge means permitting movement through an angle of substantially 270° between two useful positions, an operative, first position in which said legs extend orthogonally downward from the platform to support the platform in said elevated position, and a folded, second position in which the legs are folded onto said foot-supporting upper surface to define a generally flat configuration for enhanced transport and storage;

D) stop means provided by said hinge means operating in cooperation with said leg means and said platform, said stop means preventing inward movement of said leg means toward one another beyond the orthogonal downward first position; and E) removable elongate strut means for maintaining the legs in said operative first position, said strut means provided at opposed ends with leg engaging means removably connecting each leg means to said strut means, said strut means preventing movement of said leg means away from one another when in said operative first position, said leg engaging means being permanently spaced apart from one another by a fixed distance on said strut means.

2. The footrest according to claim 1, in which said strut means is arranged to also prevent movement of said leg means toward one another when in said operative first position.

3. The footrest according to claim 1, in which said strut means has a long axis, and said leg engaging means includes a short angle member disposed transverse to said long axis.

4. The footrest according to claim 3, in which each leg means is provided with a member-engaging loop means for removably engaging said angle member of said strut means.

5. The footrest according to claim 1, in which said leg engaging means of said strut means includes a portion that is substantially rectangular in transverse section and arranged to cooperate with a rectangular slot in said leg means to provide a resiliently biased locked position to fix said strut means in place and to provide an unlocked position for removing said strut means by rotation of said strut means about a long axis thereof.

6. The footrest according to claim 1, including fastening means for removably fastening said leg means to the upper, foot-supporting surface of said platform in the folded second position.

7. The footrest according to claim 6, in which said fastening means are hook and loop fastening means.

8. The footrest according to claim 1, in which said strut means is arranged to provide a toe hold for manipulation of said footrest with the feet.

* * * * *